252-99 AU 166 EX
9/19/78 XR 4,115,308

United States Patent [19]
Guerry

[11] 4,115,308
[45] Sep. 19, 1978

[54] HIGH-SHEAR PROCESS FOR PREPARING SILICATE-CONTAINING PASTE-FORM DETERGENT COMPOSITIONS

[75] Inventor: Raymond Ellwood Guerry, Forest Park, Ohio

[73] Assignee: The Procter & Gamble Company, Cincinnati, Ohio

[21] Appl. No.: 754,656

[22] Filed: Dec. 27, 1976

[51] Int. Cl.[2] ..... C11D 11/00; C11D 3/08; C11D 13/10; C11D 17/00

[52] U.S. Cl. ..... 252/135; 252/89 R; 252/99; 252/109; 252/DIG. 1

[58] Field of Search ..... 252/99, 135, DIG. 12, 252/89, DIG. 1; 424/49, 57

[56] References Cited

U.S. PATENT DOCUMENTS

| | | | |
|---|---|---|---|
| 3,450,813 | 6/1969 | Muhler | 424/49 |
| 3,639,288 | 2/1972 | Kerkhoven | 252/135 |
| 3,803,041 | 4/1974 | Dimitri | 252/171 |
| 3,817,875 | 6/1974 | Bazán | 252/527 |
| 3,825,498 | 7/1974 | Altenschopfer | 252/DIG. 12 |
| 3,836,641 | 9/1974 | Hoyles | 424/49 |
| 3,937,804 | 2/1976 | Delaney | 424/49 |
| 3,968,047 | 7/1976 | Smeets | 252/99 |

*Primary Examiner*—Dennis L. Albrecht
*Assistant Examiner*—Richard Bueker
*Attorney, Agent, or Firm*—Edmund F. Gebhardt; Richard C. Witte; Thomas H. O'Flaherty

[57] ABSTRACT

A process for preparing alkaline, silicate-containing paste-form detergent compositions, having good dispensing properties, is disclosed. In the disclosed process, the solid and liquid components of the detergent composition are subjected to high-shear mixing, followed by a simultaneous mixing and cooling step in which the temperature of the mixture is reduced to less than about 100° F when the temperature of the mixture exceeds about 120° F during the high-shear mixing operation. In a preferred single-step embodiment, the solid and liquid components are subjected to high-shear mixing while simultaneously being cooled such that the temperature of the mixture during mixing does not exceed about 120° F.

11 Claims, No Drawings

HIGH-SHEAR PROCESS FOR PREPARING SILICATE-CONTAINING PASTE-FORM DETERGENT COMPOSITIONS

BACKGROUND OF THE INVENTION

It is well known that the formulation of detergent compositions, for either automatic laundering or dishwashing operations, in paste-form, offers several desirable advantages to the consumer. For example, the paste-form compositions may be sold in a concentrated form, so that the consumer may use smaller, more manageable amounts of them for each wash load, thereby eliminating the necessity of storing large volumes of the compositions when they are not in use. In addition, the paste-form detergent compositions are easily dispensed and reduce the chance of spillage and waste when they are being measured out for use.

The art is replete with disclosures of processes useful for making toothpaste-type compositions. Examples of such processes are found in U.S. Pat. No. 1,947,635, Bergve, issued Feb. 20, 1934; U.S. Pat. No. 2,751,328, Sanders, issued June 19, 1956; and U.S. Pat. No. 3,703,578, Cella et al, issued Nov. 21, 1972. However, the presence of relatively high levels of inorganic components, particularly silicates, which are generally found in laundry or automatic dishwasher detergent formulations, create problems when these compositions are sought to be formulated as pastes, which are not present in the formulation of toothpaste-type compositions. The presence of these components in paste-form detergent compositions, particularly where only a minimum amount of liquid components is included, causes the compositions to "set up", which is a recrystallization of the inorganic components in the compositions. This "setting up" is undesirable since it drastically reduces the flow properties of the paste compositions, making the manufacturing and dispensing of the compositions quite difficult.

It has been found, however, that by using the process of the present invention alkaline, silicate-containing, paste-form detergent compositions, which retain their dispensing and flow properties, can be formulated.

It is therefore an object of this invention to provide an economical process whereby alkaline, silicate-containing, paste-form detergent compositions can be produced.

It is a further object of this invention to provide a process whereby alkaline, silicate-containing, paste-form detergent compositions, which are not prone to setting up, can be produced.

It is a still further object of this invention to provide a process whereby paste-form detergent compositions exhibiting good flow properties, and which therefore are easy to manufacture and dispense, can be produced.

SUMMARY OF THE INVENTION

In accordance with the present invention there is provided a process for the production of alkaline, silicate-containing paste-form detergent compositions, exhibiting good flow and dispensing properties, comprising the steps of:

(a) high-shear mixing the solid and liquid components of said composition, such that the temperature of the mixture exceeds about 80° F; followed by (b) simultaneously mixing and cooling said mixture to a temperature less than about 100° F when a temperature of about 120° F is exceeded in step (a).

In a preferred single-step embodiment of the present invention, a process for the production of such alkaline, silicate-containing, paste-form detergent compositions is provided, comprising the high-shear mixing of the solid and liquid components of the compositions such that the temperature of the mixture during mixing does not exceed about 120° F.

DETAILED DESCRIPTION OF THE INVENTION

The present invention provides a process whereby alkaline, silicate-containing, paste-form detergent compositions, exhibiting good flow and dispensing properties, can be manufactured. The steps of this process, and the components useful in the detergent compositions made by the process will be discussed in detail hereinafter.

In the process of the present invention, the solid and liquid components of the detergent composition are subjected to high-shear mixing such that the temperature of the mixture during the mixing exceeds about 80° F. The high-shear mixing may be such that such that the temperature of the mixture exceeds about 100° F. In the preferred two step embodiment of the present invention, the temperature exceeds about 120° F, during the high-shear mixing operation. This step is followed by a simultaneous mixing and cooling of the mixture to a temperature less than about 100° F when a temperature of about 120° F is exceeded during the high-shear mixing operation. If the paste-form detergent composition is not subjected to the subsequent mixing and cooling step, after the temperature during the initial high-shear mixing step exceeds about 120° F, the resulting composition will become hard and more viscous and will be difficult to pump during the manufacturing process and to dispense from a tube or bottle. It is preferred that the ratio, by weight, of solid components to liquid components subjected to this high-shear mixing step be in the range of from about 9:1 to about 1:9. It is particularly preferred that the ratio of solid to liquid components be from about 4:1 to about 1:2.

The high-shear mixing step must be such that the solid and liquid components of the detergent composition are thoroughly dispersed on a microscopic scale through intense local mixing. This type of mixing can be achieved by using conventional milling or high-shear mixing equipment. Examples of such equipment, suitable for use in the process of the present invention, include roller mills, colloid mill, Eppenbach mixers, Waring blenders, and homoloid mills.

In the course of this intense high-shear mixing step, heat is generated, causing the temperature of the mixture of solid and liquid components to increase. If the temperature of the mixture of solid and liquid components, during the high-shear mixing operation, exceeds about 120° F, the mixture is subjected to the subsequent mixing and cooling step, such that the temperature of the mixture is reduced to less than about 100° F. In a preferred embodiment, the mixture is cooled to a temperature less than about 80° F during this mixing and cooling step.

Either high-shear or low-shear mixing may be used in this second step of the process of the present invention, as long as the temperature of the mixture is brought below the critical level during the mixing. It is preferred, however, that low-shear mixing equipment be used, since a low-shear mixing process does not generate as much additional heat as would a high-shear mixing process. Examples of low-shear mixing devices useful in this step include Sigma Blade mixers, Ribbon mixers, Nauta mixers, Hobart mixers, and Littleford mixers.

A particularly preferred single-step embodiment of the process of the present invention, is one in which the solid and liquid components of the paste-form detergent composition to be produced are subjected to a high-shear mixing operation such that the temperature of the mixture does not exceed about 120° F. One way to accomplish this is to simultaneously cool the mixture during the high-shear mixing, such that the temperature of the mixture does not exceed the critical temperature. This embodiment of the invention permits the manufacture of alkaline, silicate-containing, paste-form detergent compositions, which are not subject to setting up, in a single-step mixing process. In this single-step embodiment, it is preferred that the mixing of solid and liquid components be such that the temperature of the mixture during the high-shear mixing does not exceed about 100° F, and it is particularly preferred that the mixing be such that the temperature of the mixture does not exceed about 85° F during the high-shear mixing process.

The detergent compositions manufactured by the process of the present invention are paste-form in nature, are alkaline and contain silicate components. As used herein, the term "paste" is intended to encompass paste, gel, and viscous liquid detergent compositions which generally have viscosities ranging from about 5,000 to 500,000 centipoise, but which can range up to several hundred million centipoise. The compositions may be formulated for use in automatic clothes washing machines or in automatic dishwashers, and contain the components generally found in such compositions in the art-established levels for their effective performance. Examples of paste-form laundry compositions are given in French Pat. No. 1,602,442, Henkel & Cie, GmbH, issued Dec. 31, 1970 and German Pat. No. 2,226,925, Kao Soap Company, Ltd. Paste-form detergent compositions for use in automatic dishwashers are taught in U.S. Pat. application Ser. No. 635,831, Maguire et al, filed Nov. 28, 1975; U.S. Pat. application Ser. No. 699,415, Place et al, filed June 24, 1976; U.S. Pat. application Ser. No. 699,416, Maguire et al, filed June 24, 1976; U.S. Pat. application Ser. No. 699,417, Maguire et al, filed June 24, 1976; U.S. Pat. application Ser. No. 738,416, Pardo, filed Nov. 3, 1976; and German Pat. No. 2,038,103, Henkel & Cie, GmbH, issued Feb. 10, 1972, all of which are incorporated herein by reference. In addition, automatic dishwasher and laundry detergent compositions which are generally formulated as granules, powders or liquids, may also be formulated as pastes, as long as any components incompatible with the paste form are compatibilized. Examples of such compositions are disclosed in U.S. Pat. application Ser. No. 393,879, Benson et al, filed Sept. 4, 1973; U.S. Pat. application Ser. No. 570,940, Lagasse et al, filed Apr. 22, 1975; U.S. Pat. No. 3,598,743, Coates, issued Aug. 10, 1971; U.S. Pat. No. 3,544,473, Kitchen et al, issued Dec. 1, 1970; U.S. Pat. No. 3,630,923, Simmons et al, issued Dec. 28, 1971; U.S. Pat. No. 3,892,681, Edwards et al, issued July 1, 1975; and U.S. Pat. application Ser. No. 376,641, Collins et al, filed July 5, 1973; all of which are incorporated herein by reference.

The detergent compositions of the present invention generally contain at least about 0.5% of a water-soluble surface-active agent, selected from the group consisting of anionic surfactants, nonionic surfactants, zwitterionic surfactants, and mixtures thereof. More particularly, the surfactants listed in U.S. Pat. No. 3,717,630, Booth, issued Feb. 20, 1973, and U.S. Pat. No. 3,332,880, Kessler et al, issued July 25, 1967, both of which are incorporated herein by reference, are useful in compositions manufactured by the process of the present invention. By choosing an appropriate surfactant system, along with small quantities of materials such as solubilizers, thickeners, and the like, stable paste-form compositions containing up to about 55% of the chosen surfactant system may be prepared. Preferred detergent compositions contain from about 3 to about 40% surfactant, most perferably from about 5 to about 30%. Nonlimiting examples of surfactants suitable for use in the instant compositions are as follows:

Water-soluble salts of higher fatty acids, i.e., soaps, are useful as the anionic surfactants herein. This class of surfactants includes ordinary alkali metal soaps, such as the sodium, potassium, ammonium, and alkanolammonium salts of higher fatty acids containing from about 8 to about 24 carbon atoms, and preferably from about 10 to about 20 carbon atoms. Soaps can be made by the direct saponification of fats and oils or by the neutralization of free fatty acids. Particularly useful are the sodium and potassium salts of the mixtures of fatty acids derived from coconut oil and tallow, i.e., sodium or potassium tallow or coconut soap.

Another class of anionic surfactants includes the water-soluble salts, particularly the alkali metal, ammonium and alkanolammonium salts of organic sulfuric reaction products having in their molecular structure an alkyl group containing from about 8 to about 22 carbon atoms and a sulfonic acid or sulfuric acid ester group. Included in the term "alkyl," as used herein, is the alkyl portion of acyl groups. Examples of this group of synthetic surfactants, which can be included in the detergent compositions made by the process of the present invention, are the sodium and potassium alkyl sulfates, especially those obtained by sulfating the higher alcohols ($C_8$–$C_{18}$ carbon atoms) produced by reducing the glycerides of tallow or coconut oil, and sodium and potassium alkylbenzene sulfonates, in which the alkyl group contains from about 9 to about 15 carbon atoms in straight chain or branched chain configuration. The latter type of surfactant is described in U.S. Pat. Nos. 2,220,099 and 2,477,383, incorporated herein by reference.

Other anionic surfactant compounds useful herein include the sodium alkyl glyceryl ether sulfonates, especially those ethers of higher alcohols derived from tallow and coconut oil; sodium coconut oil fatty acid monoglyceride sulfonates and sulfates; and sodium or potassium salts of alkyl phenol polyethylene oxide ether sulfates, containing from 1 to about 10 units of ethylene oxidde per molecule and wherein the alkyl groups contain from about 8 to about 12 carbon atoms.

Other useful anionic surfactants include the water-soluble salts of esters of $\alpha$-sulfonated fatty acids containing from about 6 to 20 carbon atoms in the ester group; water-soluble salts of 2-acyloxy-alkane-1 -sulfonic acids containing from about 2 to 9 carbon atoms in the acyl group and from about 9 to about 23 carbon atoms in the alkane moiety; alkyl polyethylene oxide ether sulfates containing from about 10 to 20 carbon atoms in the alkyl group, and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl groups and from about 8 to 20 carbon atoms in the alkane moiety.

Preferred water-soluble anionic surfactants herein include linear and branched chain alkylbenzene sulfonates containing from about 10 to 16 carbon atoms in the alkyl group; alkyl sulfates containing from about 10 to 16 carbon atoms in the alkyl group; the coconut range alkyl glyceryl ether sulfonates; and alkyl ether sulfates wherein the alkyl moiety contains from about 10 to 16 carbon atoms and wherein the average degree of ethoxylation varies between 1 and 6.

Zwitterionic sulfactants useful herein include derivatives of aliphatic quaternary ammonium, phosphonium, and sulfonium compounds in which the aliphatic moieties can be straight or branched chain, and wherein one of the aliphatic substituents contains from about 8 to 18 carbon atoms and one contains an anionic water-solubilizing group. particularly preferred zwitterionic materials are the ethoxylated ammonium sulfonates and sulfates disclosed in U.S. Pat. No. 3,925,262, Laughlin et al, issued Dec. 9, 1975; U.S. Pat. No. 3,929,678, Laughlin et al, issued Dec. 30, 1975; and U.S. Pat. application Ser. No. 603,837, Laughlin et al, filed Aug. 11, 1975, all of which are incorporated herein by reference.

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety, which is condensed with any particular hydrophobic compound, can be readily adjusted to yield a water-soluble compound having the desired degree of balance between hydrophilic and hydrophobic properties. A typical listing of classses and species of such nonionic surfactants useful herein appears in U.S. Pat. No. 3,664,961, incorporated by reference. Nonionic surfactants, because of their generally low sudsing properties, are particularly preferred if the detergent composition to be formulated by the process of the present invention is one for use in automatic dishwashers.

Preferred nonionic surface-active agents include alkoxylated nonionic surfactants wherein the alkoxy moiety is selected from the group consisting of ethylene oxide, propylene oxide, and mixtures thereof. Ethylene oxide represents the preferred condensation partner. The alkylene oxide moiety is condensed with a nonionic-based material according to techniques known in the art. All alkoxylated nonionic surfactants which are normally known to be suitable for use in detergent technology can be used herein. Examples of such components are disclosed in U.S. Pat. application Ser. No. 479,969, Maguire, filed June 17, 1974, incorporated herein by reference, and include:

(1) The condensation product of one mole of a saturated or unsaturated, straight or branched chain carboxylic acid having from about 10 to about 18 carbon atoms with from about 5 to about 50 moles of ethylene oxide. The acid moiety can consist of mixtures of acids in the above-delineated carbon atom range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$, and 9% $C_{16}$ with 35 moles of ethylene oxide is a specific example of a nonionic containing a mixture of different chain length fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 5 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 5 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$, and 9% $C_{16}$ with 45 moles of ethylene oxide is a specific example of a nonionic containing a mixture of different chain length alcohol moieties. Other specific examples of nonionics of this type are the condensation product of one mole of tallow alcohol with 9 and 20 moles of ethylene oxide respectively; the condensation product of one mole of lauryl alcohol with 35 moles of ethylene oxide; the condensation product of one mole of myristyl alcohol with 30 moles of ethylene oxide; and the condensation product of one mole of oleyl alcohol with 40 moles of ethylene oxide.

(3) Polyethylene glycols having a molecular weight of from about 400 to about 30,000. For examples, Dow Chemical Company manufactures these nonionics in molecular weights of 20,000, 9500, 7500, 6000, 4500, 3400, and 1450, all of which are waxlike solids which melt between 110° and 200° F.

(4) The condensation products of one mole of alkyl phenol wherein the alkyl chain contains from about 8 to about 18 carbon atoms with from about 4 to about 50 moles of ethylene oxide. Specific examples of these nonionics are the condensation product of one mole of decyl phenol with 40 moles of ethylene oxide; the condensation product of one mole of dodecyl phenol with 35 moles of ethylene oxide; the condensation product of one mole of tetradecyl phenol with 35 moles of ethylene oxide; and the condensation product of one mole of hexadecyl phenol with 30 moles of ethylene oxide.

(5) The ethoxylated surfactants disclosed in U.S. Pat. application Ser. No. 557,217, filed Mar. 10, 1975, inventor Jerome H. Collins, incorporated herein by reference, consisting essentially of a mixture of compounds having at least two levels of ethylene oxide addition and having the formula: $R_1—R_2—O(CH_2CH_2O)_nH$, wherein $R_1$ is a linear alkyl residue and $R_2$ has the formula $—CHR_3CH_2—$ wherein $R_3$ is selected from the group consisting of hydrogen, lower alkyl groups and mixtures thereof with not more than 40% by weight of lower alkyl, wherein $R_1$ and $R_2$ together form an alkyl residue having a mean chain length in the range of 8–15 carbon atoms, at least 65% by weight of said residue having a chin length within ± 1 carbon atom of the mean, wherein $3.5<n<6.5$, provided that the total amount of components in which $n = 0$ is not greater than 5% by weight and the total amount of components in which $n = 2–7$ inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Highly preferred alkoxylated nonionics for use herein include the condensation product of one mole of tallow alcohol with from about 6 to about 20 moles, especially 9 moles, of ethylene oxide; the alkoxylate commercially available under the tradename Pluradot HA-433, Wyandotte Chemical Corp., which has a molecular weight in the range from 3,700 to 4,200 and contains about 3% monostearyl acid phosphate suds suppressor; and also the condensation product of $C_{14}$ to $C_{15}$ alcohol with from 5 to 17 moles, particularly 7 to 9 moles, of ethylene oxide. An example of the last type of surfactant is commercially available under the tradename Neodol 45-7, Shell Chemical Corp., and is the condensation product of $C_{14-15}$ alcohol with 7 moles of ethylene oxide per mole of alcohol.

The detergent compositions manufactured by the process of the present invention contain various inorganic components, preferably including some hydrated materials, and particularly containing silicate components. It is preferred that these silicate components be in the form of an alkali metal silicate, or mixtures of such silicates, having an $M_2O:SiO_2$ ratio (wherein M is an alkali metal) of from about 1.6 to about 3.2. The silicate component is present in the detergent compositions in an amount of from about 1 to about 75% by weight, more preferably from about 10 to about 40%, and most preferably from about 15 to about 30%. The presence of these inorganic materials in the paste-form composition makes it prone to setting up, under usual manufacturing conditions. However, by producing the paste-form composition using the process of the present invention, this tendency towards setting up and recrystallization is greatly reduced.

The inorganic material may also be present in the form of inorganic builder materials. Such builder materials include polyphosphates, for example, tripolyphosphate, pyrophophate, or metaphosphate, carbonates, bicrbonates, and the alkali metal silicates discussed above. Particularly preferred are the sodium and potassium salts of the aforementioned inorganic builders. The builder component may also be present in the form of an organic builder compound. Examples of water-soluble organic builders include the alkali metal salts of polyacetates, carboxylates, polycarboxylates, and polyhydroxy sulfonates. Additional examples include sodium citrate, sodium oxydisuccinate, and sodium metallitate. Mixtures of the above types of builder compounds may also be used. Normally these builder ingredients can be used in amounts of up to about 60%, preferably in the range of from about 10 to 50% by weight.

The paste-form detergent compositions prefered by the process of the present invention generally contain from about 10 to about 90%, preferably from about 30 to about 80%, and most preferably from about 40 to about 70%, of inorganic commponents selected from the group consisting of silicates, phosphates, polyphosphates, carbonates, bicarbonates, borates, sulfates and mixtures thereof.

In order to provide satisfactory pasty compositions up to about 60% of a solvent, solubilizing material, or suspending agent may be included. Examples of preferred components of this type include polyethyene glycol having a molecular weight of about 400, triethanolamine, methyl esters of fatty acids, $C_{12-13}$ alcohols commercially available as Neodol 23 alcohols from Shell Chemical Corp., and mixtures thereof. Water may be used in this context and forms the continuous phase of a concentrated dispersion. In many cases, it is also desirable to include a viscosity control agent or a thixotropic agent to provide a suitable product form. For example, aqueous solutions or dispersions may be thickened or made thixotropic by the use of conventional agents such as methyl cellulose, carboxymethylcellulose, starch, polyvinyl pyrrolidone, gelatin, colloidal silica, natural or synthetic clay materials and the like.

The detergent compositions formulated using the process of the present invention, particularly those for use in automatic dishwashers, may also contain a suds regulating agent, in an amount of from about 0.001 to about 5%, preferably from about 0.05 to about 3%, by weight.

Alkylated polysiloxane materials, low density silicas, such as silica aerogels and xerogels, and hydrophobic silicas of various types are useful as suds regulating agents. Examples of such materials are described in U.S. Pat. No. 3,933,672, Bartolotta et al, issued Jan. 20, 1976, incorporated herein by reference. The polydimethylsiloxanes having a molecular weight within the range of from about 200 to 200,000, and higher, are examples of such materials. Additional useful suds controlling agents are mixtures of an alkylated siloxane and solid silica. A preferred suds controlling agent is a hydrophobic silanated (most preferably trimethylsilanated) silica having a particle size in the range of from about 10 to 20 millimicrons and a specific surface area above about 50 square meters per gram, intimately admixed with dimethyl silicone fluid having a molecular weight in the range of from about 500 to about 200,000 at a weight ratio of silicone to silanted silica of from about 19:1 to about 1:2.

Particularly useful as suds suppressors are the self-emulsified silicone suds suppressors described in U.S. patent application Ser. No. 731,257, Gault et al, filed Oct. 12, 1976, incorporated herein by reference. An example of such a compound is DB-544, which is a mixture of silica, an alkoxylated siloxane, and a siloxane/glycol copolymer, and is commercially available from Dow Corning.

Microcrystalline waxes having a melting point in the range of from about 35° to 115° C; particularly from about 65° to 100° C, and a saponification value of less than 100, may also be used as suds controlling agents in the compositions made by the process of the present invention. Examples of such waxes include: microcrystalline and oxidized microcrystalline petrolatum waxes, Fischer-Tropsch and oxidized Fischer-Tropsch waxes, ozokerite, ceresin, montan wax, beeswax, candelilla, and carnauba wax.

Alkyl phosphate esters represent an additional preferred suds suppressant for use herein. These phosphate esters are predominantly monostearyl acid phosphate which, in addition thereto, can contain di- and tristearyl phosphates, and monooleyl phosphates, which can contain di- and trioleyl phosphates.

In addition to the components described hereinbefore, the detergent compositions manufactured by the process of the present invention can also contain additional ingredients which are known to be suitable for use in laundry or automatic dishwashing detergent compositions, in the art-established levels for their known functions. Examples of such additional components include sequestering agents, china protecting agents, reducing agents, hydrotropes, corrosion inhibitors, soil suspending agents, bleaches, drainage promoting ingredients, enzymes, such as those disclosed in U.S. Pat. application Ser. No. 699,417, Maguire et al, filed June 24, 1976, and U.S. Pat. application Ser. No. 699,416, Maguire et al, filed June 24, 1976, both of which are incorporated herein by reference, enzyme stabilizing aids, brighteners, dyes, perfumes, fillers, crystal modifiers, and the like.

The following nonlimiting examples illustrate the process of the present invention.

EXAMPLE I

Paste-form detergent compositions for use in automatic dishwashers, having the formulations described below, were prepared using the process of the present invention.

| Component | % by weight A | % by weight B |
|---|---|---|
| Neodol 45-7[1] | 5.8 | 5.8 |
| Triethanolamine | 28.9 | 28.9 |
| Anhydrous sodium silicate (2.0r) | 5.8 | 5.8 |
| Hydrous sodium silicate (2.4r) | 23.1 | 23.1 |
| Polyethylene glycol (4000 M.W.) | 0.5 | 0.5 |
| Sodium tripolyphosphate hexahydrate | 34.7 | — |
| Sodium carbonate | — | 34.7 |
| SAG 100[2] | 0.9 | 0.9 |
| Dye and perfume | 0.3 | 0.3 |

[1]condensation product of one mole of $C_{14-15}$ alcohol with 7 moles of ethylene oxide.
[2]a polydimethylsiloxane silica suds suppressor, commercially available from Dow Corning.

All of the above components, except the dye, perfume, and suds suppressor components, were premixed and were then subjected to high-shear mixing using a Fitz Homoloid Mill. During this high-shear mixing step, the temperature of the mixture exceeded about 150° F. Samples of each of the compositions were then subjected to low-shear mixing, using a Sigma Blade mixer, while they were simultaneously being cooled. During this low shear mixing step, samples of each of the above two compositions were cooled to temperatures ranging from 150° to 82° F. The dye, perfume and suds suppressor components were mixed into the rest of the composition after the cooling was completed. Each of the samples was then tested to determine its ease of dispensing, using the procedure described below.

A polypropylene tube, having a ¼ inch diameter opening, was charged with about 300 grams of each paste sample. Each tube was then stored at a constant temperature of 90° F for a period of about 2 days. Each tube was then connected to an apparatus wherein a 23 lb. weight, through a system of pulleys, exerted an upward force on the tube, pulling it through two closely spaced 2 inch diameter rollers. As the tube was pulled through the rollers, a certain amount of the paste product, contained within the tube, was forced out of the tube's opening. Each of the tubes was subjected to the 23 lb. force for a period of 15 seconds, and the amount of paste product forced out of the tube in that time was weighed. This weight is proportional to the ease with which a particular paste sample is dispensed. The results obtained are summarized below.

| Temperature cooled to during low-shear mixing | Paste dispensed (grams/15 seconds) A | Paste dispensed (grams/15 seconds) B |
|---|---|---|
| 150° F | 4 | 0 |

-continued

| Temperature cooled to during low-shear mixing | Paste dispensed (grams/15 seconds) A | Paste dispensed (grams/15 seconds) B |
|---|---|---|
| 130° F | 2 | 0 |
| 120° F | — | 0 |
| 100° F | 56 | 0 |
| 82° F | 95 | 20 |

These data demonstrate the increase in dispensing properties of the paste-form automatic dishwashing detergent compositions which is achieved by the subsequent mixing and cooling of the composition, after the mixture has reached a high temperature during the initial high-shear mixing step.

Substantially similar results are obtained when the surfactant of the compositions in Example I is replaced by the condensation product of tallow alcohol with about 9 moles of ethylene oxide ($TAE_9$), or the ethylene oxide/propylene oxide condensate of trimethylol propane (commercially available from Wyandote as Pluradot HA-433), or with a similar surfactant substituted with a substantially identical alkoxylate, containing instead of the trimethylol propane radical, a radical selected from the group consisting of propylene glycol, glycerin, pentaerythritol, and ethylene diamine.

Similar results are also obtained when the suds suppressor, used above, is replaced by a silicone suds suppressor selected from the group consisting of trimethyl-, diethyl-, dipropyl-, dibutyl-, methylethyl-, and phenylmethylpolysiloxane and mixtures thereof, in an amount ranging from about 0.1% to about 1.0%. Excellent results are also obtained by using monostearyl acid phosphate suds suppressor, or a self-emulsified silicone suds suppressor, such as DB-544, commercially available from Dow Corning.

Results substantially comparable to those above can also be obtained when the suds suppressor is a microcrystalline wax having a melting point of from about 65° to 100° C and which is selected from petrolatum and oxidized petrolatum waxes, Fischer-Tropsch and oxidized Fischer-Tropsch waxes, ozokerite, ceresin, montan wax, beeswax, candelilla, and carnauba wax.

Substantially comparable results are also obtained where the builder used in the paste-form detergent composition above is replaced by sodium or potassium pyrophosphate, metaphosphate, bicarbonate; or an alkali metal salt of citric acid, oxydisuccinic acid, benzene hexa- and pentacarboxylic acid, 1,3,5-trihydroxy benzene 2,4,6-trisulfonic acid or nitrilotriacetic acid, such as sodium citrate, sodium oxydisuccinate, or sodium mellitate.

EXAMPLE II

A paste-form detergent composition for use in an automatic dishwasher, having the formulation described below, was made using the process of the present invention.

| Component | % by weight |
|---|---|
| Neodol 45-7 | 7.0 |
| Triethanolamine | 34.8 |
| Anhydrous sodium silicate (2.0r) | 7.0 |
| Hydrous sodium silicate (2.4r) | 49.2 |
| Polyethylene glycol (4000 M.W.) | 0.6 |
| SAG 100 | 1.0 |

-continued

| Component | % by weight |
|---|---|
| Dye and perfume | 0.4 |

All of the above components, except for the dye, perfume and suds suppressor components, were premixed and then subjected to high-shear mixing in a Fitz Homoloid Mill. During the course of this high-shear mixing step the temperature of the mixture exceeded about 150° F. The mixture was then subjected to low-shear mixing using a Sigma Blade mixer, and was simultaneously cooled to temperatures shown in the table below. The dye, perfume and suds suppressor components were added to the mixture after the cooling was completed. 300 grams of the various paste samples which were cooled to different temperatures during the low-shear mixing step were then placed in separate polypropylene tubes each having a ¼ inch diameter opening, and these tubes were then stored at a constant temperature of 90° F for about 2 days. The ease with which each of the compositions was dispensed was then tested using the apparatus and method described in Example I above. The results of these tests are summarized in the table below:

| Temperature cooled to during low-shear mixing | Paste dispensed (grams/15 seconds) |
|---|---|
| 150° F | 0 |
| 130° F | 0 |
| 110° F | 0 |
| 100° F | 5 |
| 82° F | 90 |

These data demonstrate the increase in ease of dispensability of this paste detergent composition, which was obtained when the composition was subjected to the simultaneous low-shear mixing and cooling step, after it had been mixed with high-shear force during which its temperature had been raised to high levels.

EXAMPLE III

A paste-form detergent product for use in automatic dishwashers, having the following composition, is formulated using the process of the present invention.

| Component | % by weight |
|---|---|
| Ethylene oxide/propylene oxide condensate of trimethylol propane | 25.0 |
| Sodium cumene sulfonate | 10.0 |
| Sodium silicate solids (2.0r) | 12.0 |
| Triethanolamine | 19.0 |
| Anhydrous sodium tripolyphosphate | 25.0 |
| SP-88[1] | 0.8 |
| Termamyl[2] | 0.4 |
| Monostearyl acid phosphate | 0.75 |
| DB-544[3] | 0.25 |
| Water and minors | balance to 100 |

[1]a proteolytic enzyme, which exhibits high activity in alkaline systems, available from Novo Industri A/S, Copenhagen, Denmark.
[2]an amylolytic enzyme, which exhibits high activity in alkaline systems, available from Novo Industri A/S, Copenhagen, Denmark.
[3]a self-emulsified silicone suds suppressor available from Dow Corning.

All of the above components, except for the enzymes, suds suppressors and minors, are premixed and are then subjected to high-shear mixing in an Eppenbach mixer. During this high-shear mixing step, the temperature of the mixture reaches about 130° F. The mixture is then placed in a Hobart mixer and is subjected to low-shear mixing while being simultaneously cooled to a temperature of about 75° F. After the mixture is cooled and while it is still being mixed, the enzyme, suds suppressor and minor components are added to the composition. The paste-form detergent composition produced provides excellent cleaning performance when used in an automatic dishwasher and is easily dispensed from a tube.

EXAMPLE IV

A paste-form detergent composition, suitable for use in automatic dishwashers, having the components set forth below, is formulated using the process of the present invention.

| Component | % by weight |
|---|---|
| Sodium tripolyphosphate | 24.1 |
| $P_2O_5$ | 10.6 |
| Sodium silicate solids (4:1 ratio by weight of 2.4r:2.0r) | 17.0 |
| $SiO_2$ | 11.9 |
| Water | 8.5 |
| Neodol 45-7 | 4.2 |
| Triethanolamine | 19.0 |
| Dye | 1.0 |
| Perfume | 0.2 |
| SAG 100 | 0.7 |
| SP-88 (in polyethylene glycol 6000 prills) | 1.2 |
| Termamyl (in polyethylene glycol 6000 prills) | 1.6 |

All of the components described above, except for the enzymes, suds suppressor, and dye and perfurme components, are premixed and are subjected to high-shear mixing using a colloid mill. During this high-shear mixing operation the temperature of the mixture reaches about 140° F. The mixture is then subjected to low-shear mixing, using a Littleford mixer, while being simultaneously cooled to a temperature of about 75° F. After the cooling is completed, but while the low-shear mixing is still going on, the enzyme, suds suppressor, dye and perfume components are mixed into the composition.

The resulting paste-form detergent composition is easily dispensed from a tube, and provides excellent cleaning of tableware and cookware when used in an automatic dishwasher.

EXAMPLE V

A paste-form detergent composition, suitable for use in an automatic dishwasher, and having the composition shown below, was produced using the process of the present invention.

| Component | % by weight |
|---|---|
| Triethanolamine | 27.7 |
| Neodol 45-7 | 5.9 |
| Anhydrous sodium silicate (2.0r) | 5.9 |
| Hydrous sodium silicate (2.4r) | 23.4 |
| Anhydrous silicate (2.0r) | 5.9 |
| Hydrous silicate (2.4r) | 23.4 |
| Sodium tripolyphosphate hexahydrate | 35.1 |
| Dye solution | 1.5 |
| Polyethylene glycol (4000 M.W.) | 0.5 |

The above components were premixed and were then subjected to high-shear mixing using a roller mill. The rollers of the mill were cooled with cold water, such that the temperature of the mixture did not exceed about 100° F during the high-shear mixing process. A second sample of this composition was run through the roller mill a second time, under the same controlled temperature conditions. 300 grams of each sample was then placed in separate polypropylene tubes each having a ¼inch diameter opening, and was stored at a constant temperature of 90° F for about 2 days. The ease of dispensing of the compositions was then tested using the apparatus and method described in Example I. The composition which had been processed once through the roller mill dispensed 15 grams in 15 seconds. The composition which had been passed twice through the roller mill dispensed 111 grams in 15 seconds. Each of the compositions exhibited acceptable dispensing characteristics out of the tube, and gave excellent cleaning performance when used in an automatic dishwasher.

Substantially similar results are obtained when the nonionic surfactant of Example V is substituted with the condensation product of tallow alcohol with about 9 moles of ethylene oxide ($TAE_9$), or an ethylene oxide/-propylene oxide condensate of trimethylol propane (commercially available from Wyandotte as Pluradot-HA-433), or with a similar surfactant substituted with a substantially identical alkoxylate, containing instead of the trimethylol propane radical, a radical selected from the group consisting of propylene glycol, glycerin, pentaerythritol, and ethylene diamine.

Substantially similar results are also obtained when the composition contains a suds suppressor, which is generally added after the composition has been subjected to the high-shear mixing step, such as a silicone suds suppressor selected from the group consisting of trimethyl-, diethyl-, dipropyl-, dibutyl-, methylethyl-, and phenylmethylpolysiloxane and mixtures thereof, in an amount ranging from about 0.1 to about 1.0%. Similar results are also obtained by using monostearyl acid phosphate suds suppressor, or a seilf-emulsified silicone suds suppressor, such as DB-544, commercially available from Dow Corning.

Results substantially comparable to those above can also be obtained when the suds suppressor used is a microcrystalline wax having a melting point of from 65° to 100° C, and which is selected from petrolatum and oxidized petrolatum waxes, Fischer-Tropsch and oxidized Fisher-Tropsch waxes, ozokerite, ceresin, montan wax, beeswax, candelilla, and carnauba wax.

Substantially comparable results are also obtained where the builder used in the paste-form detergent composition above is replaced by sodium or potassium pyrophosphate, metaphosphate, bicarbonate; or an alkali metal salt of citric acid, oxydisuccinic acid, benzene hexa- and pentacarboxylic acid, 1,3,5-trihydroxy benzene 2,4,6 trisulfonic acid or nitrilotriacetic acid, such as sodium citrate, sodium oxydisuccinate, or sodium mellitate.

EXAMPLE VI

A paste-form detergent composition suitable for use in automatic dishwashers, and having the components described below, is formulated using the process of the present invention.

| Component | % by weight |
|---|---|
| Triethanolamine | 27.8 |
| Neodol 45-7 | 6.4 |
| SAG 100 | 0.8 |
| Hydrous sodium silicate (2.4r) | 11.9 |
| Anhydrous sodium silicate (2.0r) | 11.9 |

-continued

| Component | % by weight |
|---|---|
| Polyethylene glycol (4000 M.W.) | 0.4 |
| Silicated sodium tripolyphosphate | 32.5 |
| Sodium carbonate | 8.0 |
| Dye | 0.3 |

The components described above, with the exception of the suds suppressor, are premixed and are subjected to high-shear mixing using a roller mill. The roller mill is cooled with cold water, such that the temperature of the composition does not exceed about 100° F during the mixing process. The suds suppressor component is added to the composition after the high-shear mixing step is completed.

The paste-form composition produced is easily dispensed from a tube and provides excellent cleaning performance when used in an automatic dishwasher.

EXAMPLE VII

The paste-form detergent compositions, described below, are formulated using the process of the present invention.

| Component | % by weight A | % by weight B |
|---|---|---|
| Neodol 45-7 | 7.4 | 7.4 |
| SAG 100 | 0.5 | 0.5 |
| Hydrous sodium silicate (2.4r) | 27.4 | 27.4 |
| Silicated sodium tripolyphosphate | 34.2 | 34.2 |
| Sodium carbonate | 9.5 | 9.5 |
| Polyethylene glycol (400 M.W.) | 21.0 | — |
| Neodol 23 alcohol | — | 21.0 |

The components described above, with the exception of the suds suppressor, are premixed and are then subjected to high-shear mixing using a roller mill. During this high-shear mixing process, the roller mill is cooled, using the circulation of cold water, such that the temperature of the mixture does not exceed about 85° F. After the high-shear mixing is completed, the suds suppressor is mixed in with the rest of the composition.

Each of the detergent compositions produced provides excellent cleaning when used in an automatic dishwasher, and is easily dispensed from a tube or a squeeze bottle-type dispenser.

EXAMPLE VIII

A paste-form detergent composition for use in an automatic dishwasher having the components described below, is formulated using the process of the present invention.

| Component | % by weight |
|---|---|
| Neodol 45-7 | 5.8 |
| DB-544 | 0.8 |
| Sodium silicate solids (2.0r) | 14.0 |
| Triethanolamine | 27.0 |
| Anhydrous sodium tripolyphosphate | 35.0 |
| SP-72[1] | 0.6 |
| Milezyme[2] | 0.6 |
| Water and minors | balance to 100 |

[1]a proteolytic enzyme, which exhibits high activity in alkaline systems, available from Novo Industri A/S, Copenhagen, Denmark.
[2]an amylolytic enzyme, which exhibits high activity in alkaline systems, available from Miles laboratories, Elkhart, Indiana.

The components described above, except for the enzymes, the suds suppressor and minor components, are premixed and are subjected to high-shear mixing using a roller mill. The roller mill is cooled such that the temperature of the mixture, during the high-shear mixing operation, does not exceed about 120° F. After the high-shear mixing operation is completed, the suds suppressor, enzyme and minor components are mixed in with the composition.

The paste-form detergent composition produced provides excellent cleaning performance when used in an automatic dishwasher, and is easily dispensed by the user from a squeeze-type dispenser.

What is claimed is:

1. A process for the production of alkaline, silicate-containing, paste-form detergent compositions, comprising from about 30 to about 80% of solid inorganic components selected from the group consisting of silicates, phosphates, polyphosphates, carbonates, bicarbonates, borates, sulfates, and mixtures thereof; and containing at least about 0.5% of an alkoxylated nonionic surfactant, wherein the alkoxy moiety is selected from the group consisting of ethylene oxide, propylene oxide, and mixtures thereof; wherein the amount of water-soluble alkali metal silicate in the final composition is from about 10 to about 40%; and wherein the final composition contains from about 10 to about 50% of a detergency builder selected from the group consisting of polyphosphates, carbonates, bicarbonates, organic builders and mixtures thereof; comprising the steps of:

(a) high-shear mixing the solid and liquid components of said composition, such that the temperature of the mixture exceeds about 80° F; the ratio by weight, of said solid components to said liquid components being from about 4:1 to about 1:2; followed by (b) simultaneously mixing and cooling said mixture to a temperature of less than about 80° F when a temperature of about 120° F is exceeded in step (a).

2. A process according to claim 1 wherein the temperature which the mixture exceeds during the high-shear mixing of step (a) is about 100° F.

3. A process according to claim 1 wherein the temperature which the mixture exceeds during the high-shear mixing of step (a) is about 120° F.

4. A process according to claim 1 wherein the mixture of solid and liquid components is cooled during the high-shear mixing, such that its temperature does not exceed about 120° F.

5. A process according to claim 4 wherein the temperature which the mixture does not exceed during the high-shear mixing is about 100° F.

6. A process according to claim 5 wherein the temperature which the mixture does not exceed during the high-shear mixing is about 85° F.

7. A process for the production of alkaline, silicate-containing, paste-form detergent compositions, exhibiting good flow and dispensing properties, containing at least about 0.5% of a surface active agent selected from the group consisting of nonionic surfactants, anionic surfactants, zwitterionic surfactants, and mixtures thereof; from about 10 to about 40% of a water-soluble alkali metal silicate component and from about 10 to about 50% of a detergency builder selected from the group consisting of polyphosphates, carbonates, bicarbonates, organic builders and mixtures thereof; comprising the step of (a) high-shear mixing the solid and liquid components of said composition, such that the temperature of the mixture exceeds about 80° F, the ratio, by weight of said solid components to said liquid components being from about 4:1 to about 1:2, followed by (b) simultaneously mixing and cooling said mixture to a temperature of less than about 80° F when a temperature of about 120° F is exceeded in step (a).

8. A process according to claim 7 wherein the mixture of solid and liquid components is cooled during the high-shear mixing, such that its temperature does not exceed about 120° F.

9. A process according to claim 8 wherein the surface-active agent is an alkoxylated nonionic surfactant, wherein the alkoxy moiety is selected from the group consisting of ethylene oxide, propylene oxide, and mixtures thereof.

10. A process according to claim 9 wherein the temperature which the mixture does not exceed during the high-shear mixing is about 100° F.

11. A process according to claim 10 wherein the temperature which the mixture does not exceed during the high-shear mixing is about 85° F.

* * * * *

UNITED STATES PATENT AND TRADEMARK OFFICE

CERTIFICATE OF CORRECTION

PATENT NO. : 4,115,308

DATED : September 19, 1978

INVENTOR(S) : RAYMOND ELLWOOD GUERRY

It is certified that error appears in the above-identified patent and that said Letters Patent are hereby corrected as shown below:

Column 5, line 19 "particularly" should be -- Particularly --.
Column 6, line 61, "chin" should be -- chain --.
Column 7, line 40, "bicrbonates" should be -- bicarbonates --.
Column 7, line 48 "metallitate" should be -- mellitate --.
Column 7, line 57 "commponents" should be -- components --.
Column 12, line 30 "perfurme" should be -- perfume --.
Column 13, line 36, "sèilf-emulsified" should be -- self-emulsified --.

Signed and Sealed this

*Twenty-fourth* Day of *July 1979*

[SEAL]

*Attest:*

*Attesting Officer*

LUTRELLE F. PARKER

*Acting Commissioner of Patents and Trademarks*